US007514614B2

(12) United States Patent
McGrew

(10) Patent No.: US 7,514,614 B2
(45) Date of Patent: Apr. 7, 2009

(54) ELECTRO-ACOUSTIC GUITAR

(76) Inventor: Walter Jay McGrew, 17522 Hwy. 8, Morrison, CO (US) 80465

( * ) Notice: Subject to any disclaimer, the term of this patent is extended or adjusted under 35 U.S.C. 154(b) by 107 days.

(21) Appl. No.: 11/496,347

(22) Filed: Jul. 31, 2006

(65) Prior Publication Data

US 2007/0028752 A1 Feb. 8, 2007

Related U.S. Application Data

(60) Provisional application No. 60/704,663, filed on Aug. 3, 2005.

(51) Int. Cl.
*G10D 3/00* (2006.01)

(52) U.S. Cl. ..... 84/291; 84/267; 84/290

(58) Field of Classification Search ..... None
See application file for complete search history.

(56) References Cited

U.S. PATENT DOCUMENTS

| | | | | | |
|---|---|---|---|---|---|
| 2,239,985 | A * | 4/1941 | Benioff | 84/726 |
| 4,230,013 | A | 10/1980 | Wellings | |
| 4,411,186 | A | 10/1983 | Faivre | |
| 4,773,295 | A * | 9/1988 | Visser | 84/276 |
| 5,461,193 | A | 10/1995 | Schertler | |
| 5,682,003 | A | 10/1997 | Jarowsky | |
| 5,811,704 | A * | 9/1998 | Anderko | 84/470 R |
| 5,918,299 | A * | 6/1999 | Yui | 84/291 |
| 5,945,622 | A * | 8/1999 | Yamada | 84/731 |
| 6,188,005 | B1 | 2/2001 | White | |
| 6,191,350 | B1 * | 2/2001 | Okulov et al. | 84/646 |
| 6,525,246 | B1 | 2/2003 | Erismann | |
| 6,646,190 | B2 | 11/2003 | Brown | |
| 6,696,627 | B2 * | 2/2004 | Florath et al. | 84/290 |
| 6,891,094 | B2 * | 5/2005 | McCabe | 84/312 R |
| 2005/0155480 | A1 * | 7/2005 | Joseph | 84/299 |
| 2006/0096438 | A1 * | 5/2006 | Clark | 84/290 |

* cited by examiner

*Primary Examiner*—Marlon T Fletcher
(74) *Attorney, Agent, or Firm*—Craig Barber

(57) ABSTRACT

The present invention teaches an electro-acoustic guitar having an isolated resonant soundboard with or without an integrated transducer attached to the soundboard. The soundboard/transducer assembly fits into an aperture of the guitar body frame and has structure allowing it to be adjusted in multiple axes to provide the best playing action. The soundboard may also be interchangeable with other soundboards to further alter sound quality. String vibration energy is conducted by an acoustically pure bridge to the soundboard/transducer assembly. The large magnetic transducer is integrated by having one portion, a magnet structure, secured to a magnet support and another portion, the voice coil and mounting hub, secured to the soundboard spaced and opposed above the magnet support thus creating a truly integrated electro-mechanical soundboard transducer assembly with tonal qualities modified by an internal chamber defined by the space between the soundboard and the magnet structure support.

10 Claims, 7 Drawing Sheets

ELECTRO-ACOUSTIC GUITAR

CROSS-REFERENCE TO RELATED APPLICATION

The application claims the benefit and priority of U.S. Provisional Patent Application No. 60/704,663 filed Aug. 3, 2005 in the name of the same inventor, Walter McGrew, and entitled ELECTRO-ACOUSTIC GUITAR.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

FIELD OF THE INVENTION

This invention relates generally to musical instruments, and specifically to guitars.

STATEMENT REGARDING FEDERALLY FUNDED RESEARCH

This invention was not made under contract with an agency of the US Government, nor by any agency of the US Government.

BACKGROUND OF THE INVENTION

Stringed musical instruments capable of converting string vibration energy to acoustic form have been used for centuries for entertainment. Guitars capable of converting string vibration energy to acoustic and electrical forms have provided entertainment for decades. The addition of the electrical form has provided the ability to increase amplification of acoustic output and the ability to modify the electrical signal for varied acoustical effects. While many variations exist (such as U.S. Pat. No. 4,411,186, having an interchangeable soundboard or U.S. Pat. No. 6,188,005 also having an interchangeable soundboard, or U.S. Pat. No. 5,682,003 having acoustic chambering), the applicant is not aware of any type of guitar having a soundboard action adjustment system, nor an integrated transducer system.

An acoustic guitar actually depends very heavily on the resonant chamber behind the strings to amplify and provide depth and warmth to the faint sounds produced by the strings. In other words, the rich sounds of the various types of traditional guitars are due to the various types of construction of the body of the guitar.

Electrical guitar types, on the other hand, produce a different selection of sounds and timbres because such guitars have the ability to electrically/magnetically pickup and amplify the sounds made by their strings. They can produce a wide range of sounds, greater amplitude and may allow for easy electronic adjustment and recording of the sounds produced. However, in an acoustic sense, an electric guitar (most are not hollow) does not resonate, and occasionally experts may refer to inexpensive electric guitars as "planks".

U.S. Pat. No. 6,646,190 issued Nov. 11, 2003 to Brown, teaches an acoustic instrument with a spring supported soundboard, however, it does not teach that such a soundboard may have adjustment devices, nor does it teach that the device may be electro-acoustical, having structures for use with electrical pickups of any type.

U.S. Pat. No. 4,230,013 issued Oct. 28, 1980 to Wellings teaches an electrical-acoustic transducer. However, the '013 reference device is "adapted to be mounted in intimate contact with" a musical instrument (a piano is pictured). Thus it teaches away from an integrated transducer and teaches nothing relevant to guitar sound boards at all.

U.S. Pat. No. 6,525,246 issued Feb. 25, 2003 to Erismann teaches a style of guitar having a metal framework serving as a detachable body. It appears to be acoustically inert and does not teach transducers relevant to the present invention.

U.S. Pat. No. 6,188,005 issued Feb. 13, 2001 to White teaches a guitar sounding board which has a lattice-work "acoustic grille", which may have known transducers mounted thereon. It lacks any integrated transducer and teaches away from sound boards as taught by the present invention.

U.S. Pat. No. 5,461,193 issued to Schertler on Oct. 24, 1995 teaches a transducer having a housing "which can be secured to the resonant body" and thus teaches away from integrated transducer structures of the present invention as well as teaching nothing towards sound boards.

It is worth noting that various hybrid electro-acoustic guitars may be known in the prior art, but that such hybrids do not teach an mechanically adjustable sound board, nor do they teach an integrated acoustically active transducer. U.S. Pat. No. 5,682,003 issued to Jarowsky on Oct. 28, 1997 teaches an alternative type of electro-acoustic guitar having a central sounding chamber and two horn shaped passages to communicate with the exterior. It teaches nothing about integrated transducers, nor about adjustable sounding boards.

U.S. Pat. No. 4,411,186 to Faivre on Oct. 25, 1983 teaches another type of electro-acoustical guitar having a sounding board, but does not teach an integrated transducer or an acoustically adjustable sound board, nor the structures of the present invention for carrying these out.

Thus, while exchangeable sound boards are known, mechanically adjustable soundboards, acoustically integrated transducers and soundboard assemblies of the construction taught herein are not known.

It would be advantageous to provide a guitar having improved acoustic qualities and improved transducer structures and having instantaneous action adjustment.

SUMMARY OF THE INVENTION

General Summary

The present invention teaches a stringed instrument including a neck rigidly attached to a body frame and isolated in the body frame by a three point resonant suspension, an interchangeable soundboard assembly with or without an integrated transducer assembly. The soundboard/transducer assembly has variable acoustic properties and a soundboard coupled voice coil moving in a magnetic field to produce an electrical output proportional to the vibrations of the strings. The instrument is further modified by the addition of adjustable mechanical couplings to allow the resonant soundboard assembly or soundboard/transducer assembly to be easily adjusted within the guitar body frame in order to fine tune the playing action and thus the sound quality of the instrument. This creates a unique ease of use and sound quality not known in any conventional instrument and superior to many guitars.

The ability to adjust the entire soundboard/transducer to fine tune the playing action eliminates the need to have a separately height adjustable bridge, allowing an acoustically pure bridge (no set screws, threads, etc) coupling the strings to the soundboard in a manner more akin to a violin than to a guitar.

The soundboard/transducer assembly is further easily removable so as to facilitate interchangeability between soundboard/transducer assemblies having different acoustic and/or electrical properties, thus allowing convenient alteration of the sound qualities of the instrument. For example different soundboards, though interchangeable, may have different shapes (with segments or material removed), different types of transducers, different thicknesses and resonant properties of material, different chambering and so on, by which means amplitude of deflection, frequency response, resonant frequencies, acoustic amplitude, feedback and other properties may be altered. Tuning ports and sound holes may also be used in interchangeable soundboards.

The adjustable mechanical couplings between the soundboard and the transducer magnet structure support allow them to be adjusted in relation to each other to adjust coupling tension and therefore timbre of the guitar. These adjustments are different from and in addition to the adjustment of the mechanical or other fasteners between the soundboard and the body frame.

Summary in Reference to Claims

It is therefore a first aspect, advantage, objective and embodiment of the invention to provide a musical instrument comprising:

a substantially rigid body frame having an aperture therethrough;

a neck secured to the body frame at a first location;

a plurality of strings having first ends and second ends and attached to the neck at the first ends and attached to the body frame at a second location distal the first end, the strings under tension;

at least three suspension couplings located at least at third, fourth and fifth locations of the body frame proximate the aperture;

a soundboard assembly disposed at the aperture and attached to the suspension couplings the suspension couplings resonantly isolating the soundboard from the body frame, the soundboard assembly having a soundboard comprising a first plate;

a bridge secured to the soundboard, the plurality of strings urged against the bridge by the tension of the strings; and a transducer having a coil in resonant communication with the soundboard.

It is therefore a second aspect, advantage, objective and embodiment of the invention to provide a musical instrument comprising:

the soundboard assembly further comprising a magnet structure support comprising a second plate, the soundboard assembly further comprising a separation between the first and second plates defining a chamber between the first and second plate, the second plate having a second aperture therethrough;

the transducer having a magnet structure attached to the second aperture of the second plate of the soundboard assembly, the transducer coil attached to the soundboard and suspended in magnetic communication with the magnet structure, whereby: relative motions of the soundboard and second plate cause relative motions of the voice coil and magnetic structure, inducing an electrical output signal.

It is therefore another aspect, advantage, objective and embodiment of the invention to provide a musical instrument comprising:

a non-integral pick-up secured to the musical instrument.

It is therefore another aspect, advantage, objective and embodiment of the invention to provide a musical instrument comprising:

an adjuster having a first position in which the strings are disposed further from the neck and having a second position in which the strings are disposed closer to the neck;

whereby: the strings may be adjusted in a plurality of dimensions.

It is therefore another aspect, advantage, objective and embodiment of the invention to provide a musical instrument wherein a first of the three suspension couplings is disposed in-line with the axis of the strings, the first suspension coupling further comprising a hand hold allowing an immediate manual alteration of the first suspension coupling between the first and second positions, whereby: adjustment of the strings may be immediately manually altered.

It is therefore another aspect, advantage, objective and embodiment of the invention to provide a musical instrument comprising:

at least one sound hole or tuning port in the soundboard assembly.

It is therefore another aspect, advantage, objective and embodiment of the invention to provide a musical instrument, wherein the soundboard and magnet structure support are attached together at two or more locations and the chamber defined therebetween is arcuate in shape.

It is therefore another aspect, advantage, objective and embodiment of the invention to provide a musical instrument wherein the soundboard and magnet structure support are connected by a plurality of spacers which maintain the plates in parallel separation.

It is therefore another aspect, advantage, objective and embodiment of the invention to provide a musical instrument comprising:

a back skin across the back of the body frame, closing the aperture on the back side of the body frame.

It is therefore another aspect, advantage, objective and embodiment of the invention to provide a musical instrument comprising:

a non-integral transducer secured to the musical instrument in addition to the integral transducer.

It is therefore another aspect, advantage, objective and embodiment of the invention to provide a musical instrument wherein:

the soundboard assembly further comprising a magnet structure support comprising a hub and a plurality of struts, the soundboard assembly further comprising a separation between the first plate and the magnet structure support defining an open chamber, the hub having a second aperture therethrough;

the transducer having a magnet structure attached to the second aperture of the hub of the soundboard assembly, the transducer coil attached to the soundboard and suspended in magnetic communication with the magnet structure, whereby: relative motions of the soundboard and hub cause relative motions of the voice coil and magnetic structure, inducing an electrical output signal.

It is therefore another aspect, advantage, objective and embodiment of the invention to provide an improved stringed instrument of the type having a soundboard, a neck, strings acoustically communicating with the soundboard, string retainers, and a body, wherein the improvement comprises:

an aperture through the body, a soundboard assembly disposed within the aperture and isolated therefrom by at least three suspension couplings, the soundboard having first and second plates with a chamber defined therebetween.

It is therefore another aspect, advantage, objective and embodiment of the invention to provide an improved stringed instrument of the type having a soundboard, a neck, strings acoustically communicating with the soundboard, string retainers, and a body, wherein the improvement comprises:

an aperture through the body, a transducer having a magnet structure attached to the aperture of the body;

a voice coil attached to the soundboard and suspended in magnetic communication with the magnet structure.

BRIEF DESCRIPTION OF THE DRAWINGS

FIG. 1*a* is a side view of strings, bridge, and anchor with an indication of the force applied by the strings to the bridge.

INDEX TO REFERENCE NUMERALS

Figure 1:
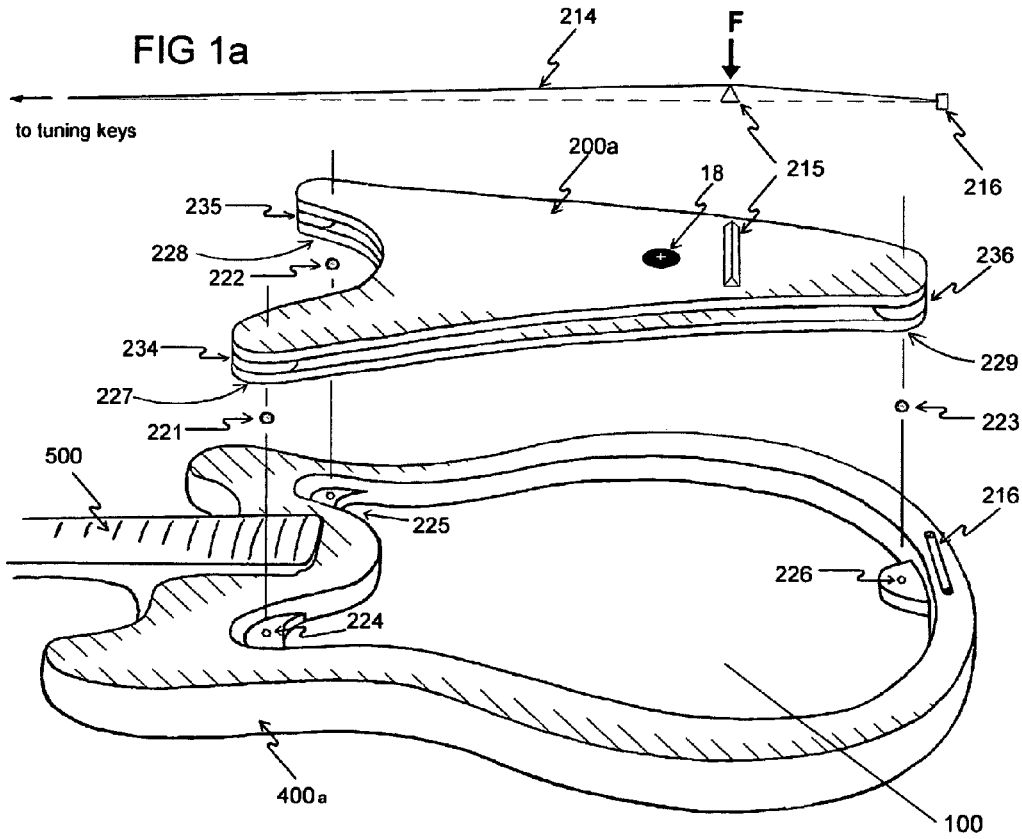
FIG. 1 is an exploded side perspective view of a first embodiment of a guitar body frame, neck and an isolated/suspended integrated soundboard/transducer unit.

| INDEX TO REFERENCE NUMERALS | |
|---|---|
| Fasteners | 7 |
| Magnet assembly | 10 |
| Magnet structure support | 11 |
| Bottom magnet structure support | 11a, 11b, 11c, 11d |
| Center pole piece | 12 |
| Retention cup | 13 |
| Outboard pole piece | 15 |
| Cylindrical magnet | 16 |
| Fastener | 18 |
| Coil wire output leads | 19 |
| Soundboard | 22 |
| Top soundboard plate | 22a, 22b, 22c, 22d |
| Voice coil | 24 |
| Fastener | 25 |
| Coil mounting hub | 28 |
| Annular slot | 33 |
| Aperture | 100 |
| Sound holes/ports | 111 |
| Hub and spoke support structure | 112 |
| Soundboard/transducer assembly | 200, 200a, 200b, 200c, 200d, 200e |
| Suspension couplings, spherical | 221, 222, 223 |
| Bridge | 215 |
| String anchor | 216 |
| Strings | 214 |
| Sockets | 224, 225, 226, 227, 228, 229 |
| Adjustable suspension couplings | 231, 232, 233 |
| Spacers | 234, 235, 236 |
| Back skin | 239 |
| Fitting | 240 |
| Adjustable coupling with hand hold | 241 |
| Conventional magnetic pickup | 242 |
| Surface pickup microphone/transducer | 243 |
| Chamber | 244 |
| Suspension points | 257, 258, 259 |
| Guitar body frame | 400, 400a, 400b |
| Neck | 500 |
| Location A | A |
| Location B | B |
| Location C | C |
| Side to side height | a2, b2 |
| Gross height | c2 |
| String force applied to bridge | F |

DETAILED DESCRIPTION

FIG. 1 is an exploded side perspective view of a first embodiment of a guitar body frame 400*a*, neck 500 and an isolated/suspended integrated soundboard/transducer unit 200*a*, strings 214 and bridge 215, with an indication (FIG. 1*a*) F of the force applied by the strings 214 to the bridge 215. The stringed instrument of the invention (guitar, violin, viola, bass, banjo, fiddle, and so on) may be made of wood in presently preferred embodiments and best modes now contemplated, but is not so limited: the body frame and device may be polymer, metal, composite and so on. Regardless, the material selected for the body frame 400*a* provides a structurally rigid perimeter having a void or aperture 100 passing therethrough. A soundboard/transducer assembly 200*a* is dimensioned and configured to fit within the aperture 100. Three or more mechanical suspension couplings 221, 222, 223 support the soundboard/transducer assembly 200*a*, however the soundboard/transducer assembly 200*a* is isolated from the body frame 400*a* by the suspension couplings 221, 222, 223 so that vibrations in the soundboard/transducer assembly 200*a* are substantially confined to the soundboard/transducer assembly 200*a*. A typical guitar has a front face of the guitar body which acts as soundboard and is firmly affixed to the periphery of the body.

As a result, vibrations from the strings 214 may be passed through bridge 215 to the soundboard/transducer assembly 200*a* and may be maintained with a stronger amplitude and reinforced acoustically to a greater degree due to the nature of the isolated soundboard.

The suspension couplings may be a number of types of structures: screws, set screws, wedges, bumpers, mounts, blocks, and spherical connectors. All such couplings may be made of rigid materials, as the small size of the suspension couplings ensures acoustic isolation of the soundboard. The couplings may also be formed as projections of the soundboard/transducer assembly or may be formed as projections from the rigid body frame 400*a*, provided the relative size of the coupling is quite small compared to the size of the soundboard assembly.

Strings 214 may be secured to tuning structures at the distal end of the neck of the musical instrument at their first ends and at the string anchor 216 at their proximal ends. Bridge 215 slightly deflects the strings from an exactly straight vector between the neck connection and anchor. As a result, strings 214 exert a force depicted by arrow F in FIG. 1*a*. This force will tend to urge the bridge 215 against the soundboard/transducer assembly 200*a*, so that the strings are acoustically coupled to the soundboard. Spacers such as 234 may be seen to provide a separation or chamber between the two opposing plates. (Also, this in turn urges the soundboard/transducer assembly 200*a* against the suspension couplings 221, 222, 223, thus holding the instrument together in embodiments.) In the embodiment depicted in FIG. 1, spherical suspension couplings may in turn be driven into corresponding sockets 224, 225, 226, 227, 228, 229, and thereby be trapped, thus locating and suspending the soundboard/transducer assembly 200*a* in place against the body frame 400*a* but acoustically linking the soundboard to the strings 214, so the soundboard vibrates due to string motions, while on the other hand the rigid body frame 400*a* and couplings to it are not allowed to do so and are thus prevented from wasting string energy. Testing has revealed that musical instruments of this type are mechanically stable and quite strong. Nonetheless, string energy is substantially isolated and concentrated in the soundboard/transducer assembly 200*a*, which provides a very high available mechanical signal strength (that is, prior to electronic amplification) for the transducer to produce a high output electrical signal, which in turn provides a cleaner signal of higher fidelity. Not only is the pre-amplification sound much louder than that produced by an ordinary electric guitar with a rigid body, but also the nature of the sound is altered.

Obviously another advantage of the system is the ability to interchange soundboard/transducer assembly 200*a* with another different model so as to alter sound quality.

Sockets 224, 225, 226, 227, 228, 229 may be conical, concave, hemispherical indentations or cavities, or internally threaded, or may have flanges, lips, sills, projections and so on.

Spacers 234, 235, 236 may be seen to provide the soundboard/transducer assembly 200*a* with two different opposing plates and a separation or chamber between them.

Figure 2:
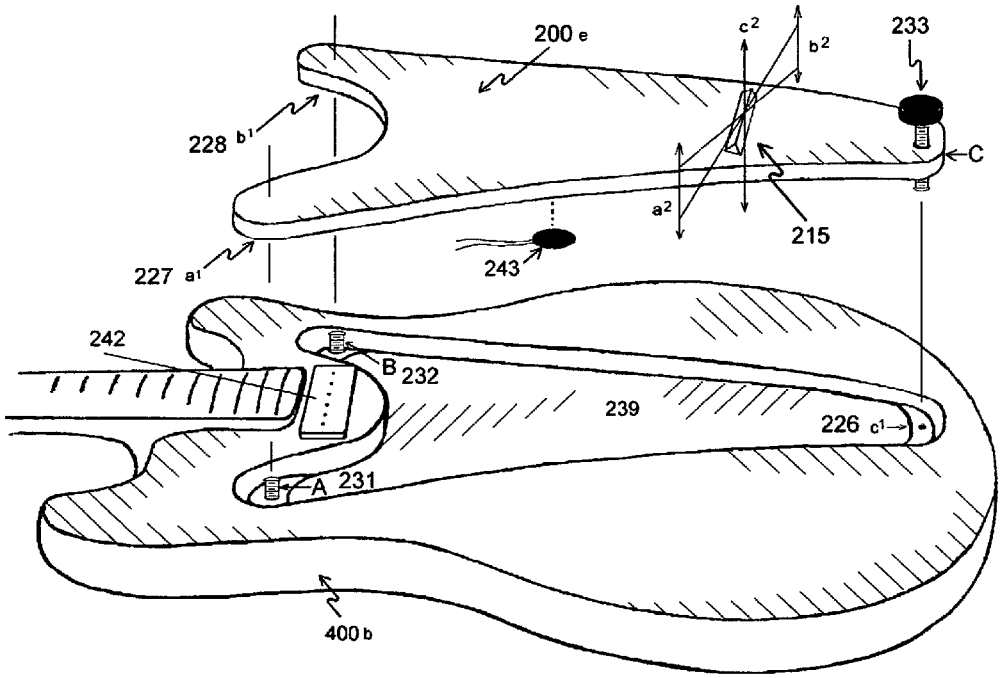
FIG. 2 is an exploded perspective view of a second embodiment of a guitar body frame with an isolated soundboard without an integrated transducer (with a conventional attached pickup instead), with indications of the relative motions of strings due to adjustment of the soundboard.

FIG. 2 is an exploded perspective view of a second embodiment of a guitar body frame 400*b* with an isolated soundboard assembly 200*e* without an integrated transducer (with a conventional attached transducer 243 instead), with indications of the relative positioning of the strings due to adjustment of the soundboard.

Three linearly adjustable suspension couplings 231, 232, 233, may be located at three different locations A, B and C (C distal) on the body frame 400*b* at the aperture or void. The suspension couplers may be metal, polymer, wooden, composite or other materials. They may have hand holds such as knobs, key flats, levers, handles, fingerholds, knurls or the like allowing convenient manual manipulation by a user. They may also have devices allowing convenient manipulation in other ways, for example, they may have hex heads, "ALLEN™" heads, slot heads, "PHILLIPS™" heads and the like allowing manipulation by tools, or they may have actuators allowing remote actuation by means of electronics, cable or the like. They may be threaded into sockets of the rigid body frame and soundboard assembly by internal threading on the sockets and external threading on the couplings or otherwise provided with structures allowing them to be raised and lowered into at least two positions relative to the body frame 400*b*, thus moving the soundboard assembly into a plurality of positions in at least three dimensions (one dimension of translation and two dimensions of rotation). These dimensions may be depicted by arrows a2, b2 and c2. By manipulating by tool or hand the threaded coupling 231 at point A and/or the threaded coupling 232 at point B, the soundboard/transducer assembly 200*e* may be tilted from side to side relative to the frame (arrows a2, b2), resulting in different positions or dispositions of different strings of the musical instrument, or the entire soundboard/transducer assembly 200*e* may be raised or lowered as well as tilted about an axis approximately parallel to the axis of the strings of the instrument. In addition, manipulation by hand or tool of the threaded coupling 233 at point C, located most closely in line with the strings and anchor and bridge 215*b*, the end of the soundboard/transducer assembly 200*e* may be raised or lowered without rotation about the axis of the strings, thus moving it further "in" or "out" of the aperture of the rigid body frame 400*a*. This provides a very fast string action adjustment mechanism.

Note that this embodiment shows an aperture 100 which does not go entirely through the body frame, having a back skin 239 across one side (the back) of the aperture.

It is also worth noting that many prior art guitars feature complex bridges having irregular shapes and numerous screws or other devices for adjusting the string action at the bridge. One side effect of such known systems is that the complex bridge is not acoustically clean and alters the sound in undesirable ways as the sound is transmitted from strings to soundboard. While other instruments may have simple bridges, the simple bridges do not provide users the ability to adjust the strings. The present invention, on the other hand, allows instant adjustment of string action without any impediment to clean transmission of sound from string to soundboard.

Figure 3:
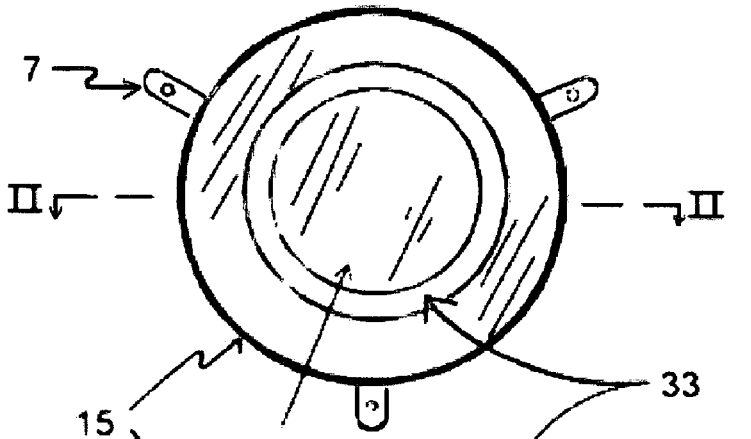
FIG. 3 is a top view of the structure of an integrated transducer magnet component detached, with indicia of a cross section line for FIG. 4.
Figure 4:
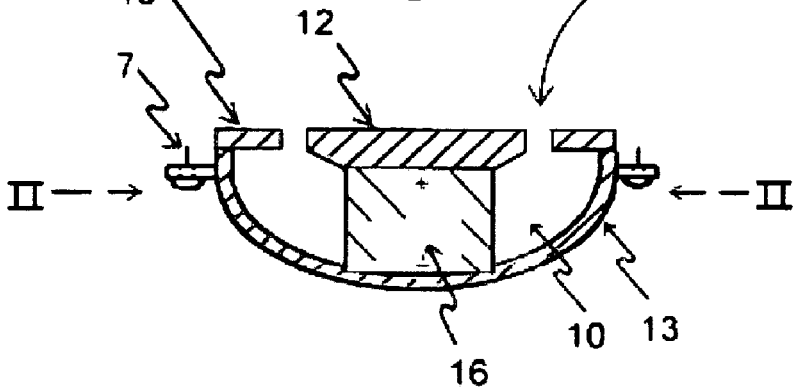
FIG. 4 is a cross sectional side view of the integrated transducer component of FIG. 3.
Figure 5:
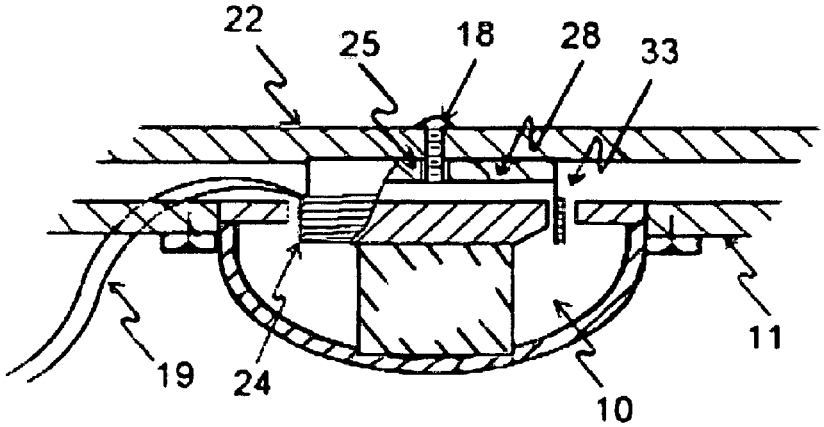
FIG. 5 is a cross sectional view of the integrated transducer component in the actual integrated position, showing magnet structure, magnet structure support, coils and soundboard.

FIG. 3 is a top view of the transducer magnet structure with support structure detached, with indicia of a cross section line for FIG. 4; FIG. 4 is a cross sectional side view of the integrated transducer component, while FIG. 5 is a cross sectional view of the integrated transducer component in the actual integrated position, showing magnet structure, magnet structure support 11 (the second plate of the soundboard/transducer assembly), coil and soundboard.

It will be appreciated that a hole in the integrated soundboard/transducer assembly's lower or back plate is a magnet structure support 11 dimensioned and configured to accept a magnet structure component 13 fastened thereto by means of fasteners 7, and this supports the overall magnet assembly 10.

Center pole piece 12 is supported inside retention cup 13 while outboard pole piece 15 is supported at the opening or mouth of the interior of the retention cup 13 concavity/interior, it may be seen that cylindrical magnet 16 supports center pole piece 12 within the retention cup 13, and between the two pole pieces they define annular slot/gap 33, however, the annular gap 33 is in magnetic communication with the magnetic poles on either side of it so a strong magnetic field will be present in the gap. These parts may be bonded together by means of adhesive, welding, additional fasteners, fittings, physical engagement to each other or other means in order to form the magnet assembly, that is to form the magnetic field which will interact with a voice coil to produce electrical output signals.

Magnet assembly 10 is solely supported by the second plate, while the coil is supported by the soundboard. Coil wire output leads 19 receive output signal from voice coil 24. It will be seen that voice coil 24 is suspended disposed and concentric within the annular slot/gap 33, and in magnetic communication with the field of the magnet structure.

As a result of these structures, it will be seen that vibrations of the soundboard 22 in relation to the lower plate of the soundboard (magnet structure support 11) will cause translation of the voice coil 24 in the annular slot 33 in relation to the magnet structure. Such motion while in magnetic communication induces a current in the output signal wires 19, which provides a truly integrated electronic soundboard/transducer assembly: different parts of the transducer are literally located on different plates of the soundboard assembly.

At the risk of prolixity, string vibrations in soundboard plate 22 relative to the magnet structure support plate 11 cause coil 24 to translate relative to the magnetic field established in magnetic structure 10, inducing an electrical current proportional to the string vibrations, which may then be amplified externally by known means.

Figure 6:
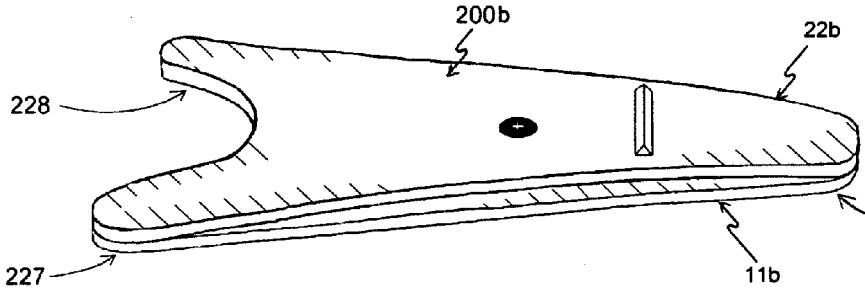
FIG. 6 is a perspective view of an arched third embodiment of a soundboard assembly.
Figure 7:
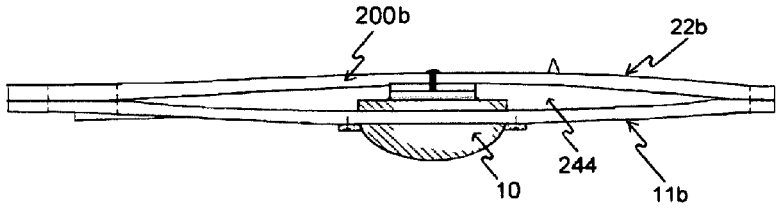
FIG. 7 is a side view of the arched third embodiment of the soundboard assembly, showing the integrated transducer.
Figure 8:
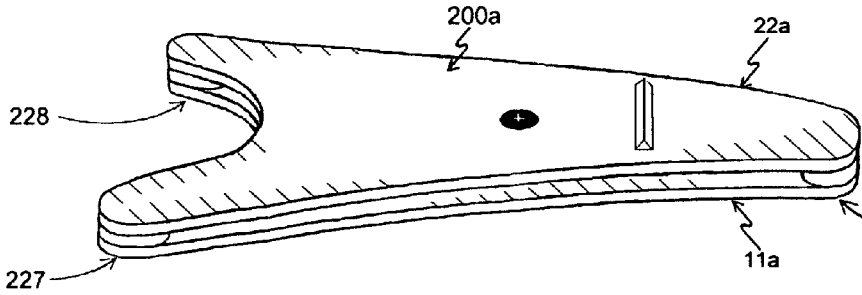
FIG. 8 is a perspective view of a flat fourth embodiment of a soundboard assembly.

FIG. 6 is a perspective view of an arched third embodiment of a soundboard assembly, and FIG. 7 is a side view of a arched third embodiment of the soundboard assembly, showing the integrated transducer. FIG. 8 on the other hand is a perspective view of a flat fourth embodiment of a soundboard assembly while FIG. 9 is a side view of the flat fourth embodiment of the soundboard assembly, showing the integrated transducer.

Figure 9:
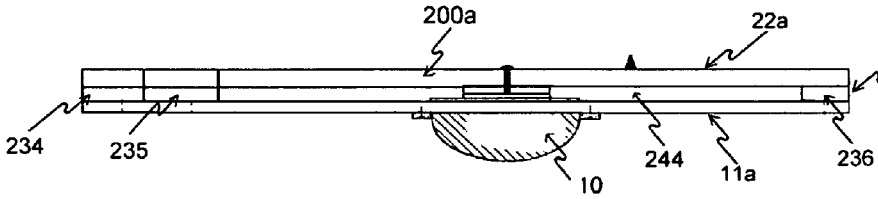
FIG. 9 is a side view of the flat fourth embodiment of the soundboard assembly, showing the integrated transducer.

Top soundboard plates 22*a*, 22*b* of soundboard assemblies 200*a*, 200*b* have fasteners 18 holding on the voice coil (not visible), side views FIG. 7 and FIG. 9 show the magnet assemblies 10. From the side views, sound chambers 244 may be clearly seen. This sound chamber 244 is partially defined by the soundboards' 22*a*, 22*b* separations from the back plates 11*a*, 11*b* of the soundboard assembly of the overall soundboard assembly.

The embodiment of FIGS. 6 and 7 has a separation between the two plates of the soundboard assembly which is acuate in shape, defined by the fact that three distal ends of the soundboard 22*b* and the magnet support plate 11*b* are attached together directly. On the other hand, the embodiment of FIGS. 8 and 9 has a separation which is of regular shape, as spacers 234, 235, 236 allow the front and back plates of the soundboard assembly to be parallel to one another. Other sectional configurations of soundboard assemblies are possible in embodiments.

Figure 10:
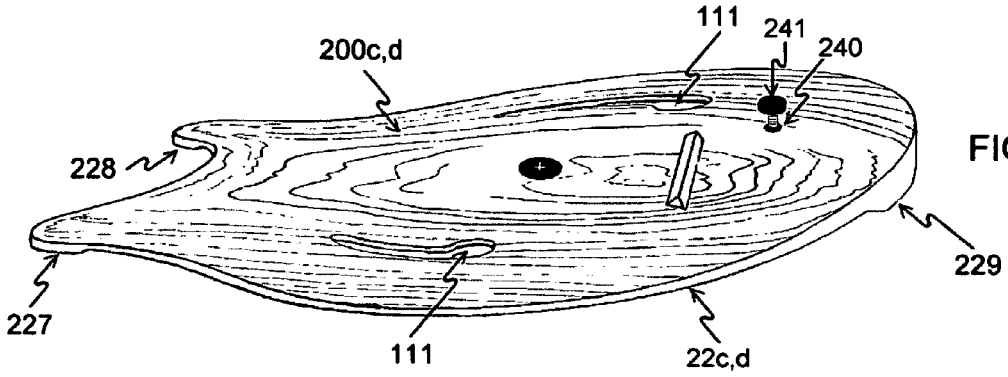
FIG. 10 is a perspective view of a fifth embodiment of a soundboard assembly with sound holes and a mechanical tone adjustment control.
Figure 12:
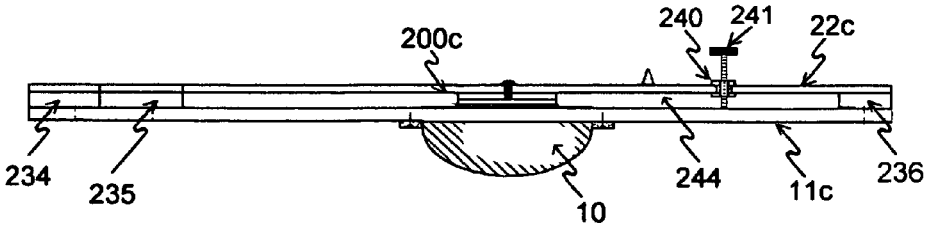
FIG. 12 is a side view of the integrated soundboard assembly of the fifth embodiment (FIG. 10) with a flat soundboard.

FIG. 10 is a perspective view of a fifth embodiment of a soundboard assembly 200*c* with sound holes 111 from the sound chamber 244 to the exterior and a mechanical tone adjustment control 241, and FIG. 12 is a side view of the integrated soundboard assembly of the fifth embodiment (FIG. 10) with a flat soundboard 22*c*. Sound holes 111 allow different acoustic properties than a solid soundboard. Knob 241 tone control is separate and different from action adjustment 233.

Figure 11:
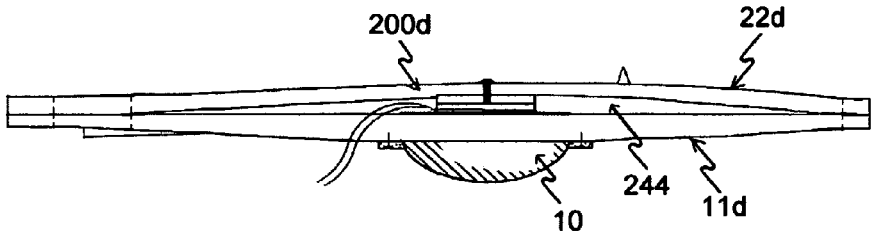
FIG. 11 is a side view of a sixth embodiment, a sub-embodiment of the fifth embodiment (FIG. 10) but having an arched soundboard and the mechanical tone control.

Suspension points 227, 228, 229 may be projections from the soundboard assembly 200*c*, glue laminations at the same locations may allow the attachment of spacers 234, 235, 236 or, as shown in FIG. 11 (a side view of a sixth embodiment, a sub-embodiment of the fifth embodiment) glue laminations may allow an arched soundboard assembly and chamber 244 by affixing the two plates 22*d* and 11*d* together at points 227, 228, 229 to comprise soundboard/transducer assembly 200*d*.

In either embodiment, the transducer is held with the magnet structure on the bottom plate and the voice coil assembly on the top plate, to create the unitized, integral electro-mechanical resonating soundboard assembly, broadly 200*a*, 200*b*, 200*c*, 200*d* of the various figures.

Variations in the perimeter shape of the soundboard assembly allow further tuning of sound quality, and interchanging of such variable shaped soundboard assemblies allows quick changing of tonal qualities of the musical instrument.

Figure 13:
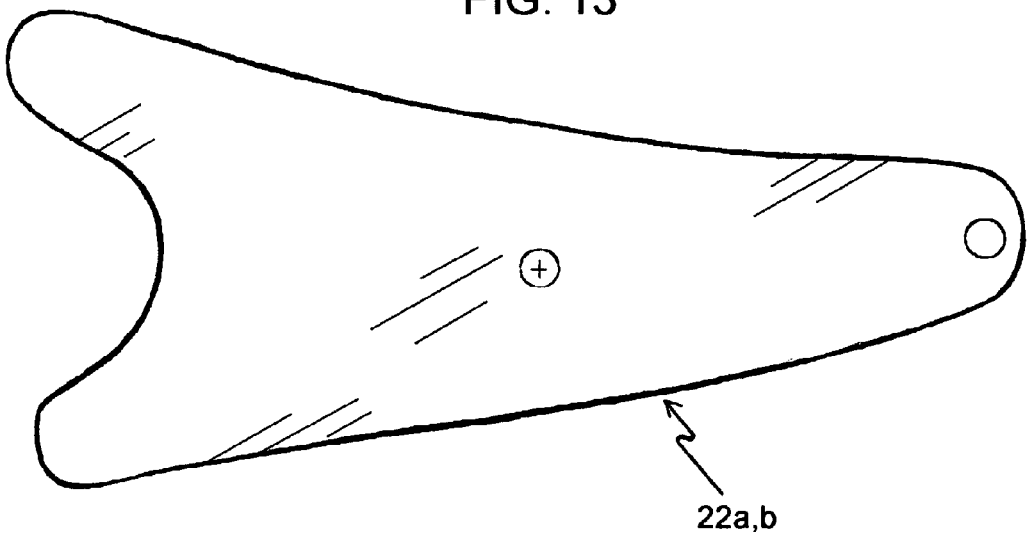
FIG. 13 is a top planform view of the soundboards of the embodiments of FIGS. 1, 2, 6, and 8.
Figure 14:
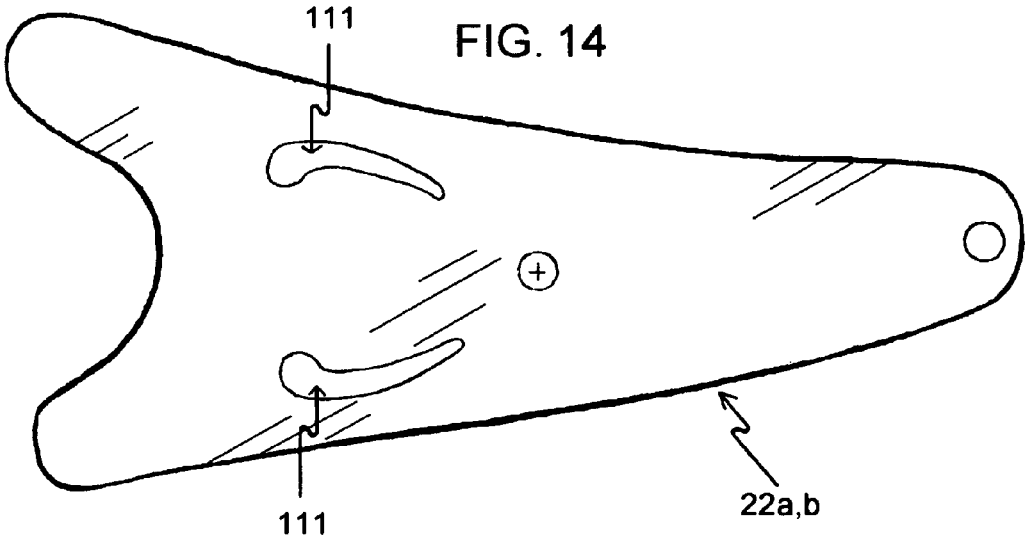
FIG. 14 is a top planform view of the soundboard of the embodiment of FIG. 10, with sound holes.
Figure 16:
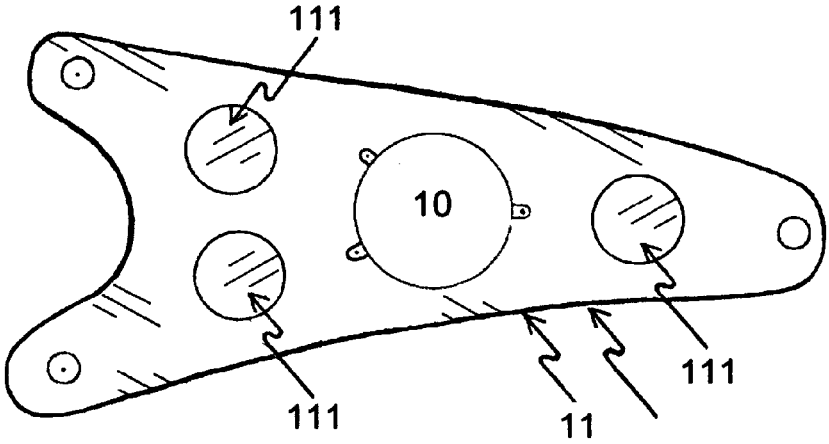
FIG. 16 is a bottom view of the integrated soundboard/transducer unit of a seventh embodiment of the invention having sound holes.

FIG. 13 is a top planform view of the soundboards of the embodiments of FIGS. 1, 2, 6, and 8, sans sound holes, while FIG. 14 is a top planform view of the soundboard of the embodiment of FIGS. 1, 2, 6 and 8 with sound holes or ports 111. FIG. 16 is a bottom view of the integrated soundboard/transducer unit of a seventh embodiment of the invention having bottom sound holes, that is sound holes in the plate of the magnet support plate 11.

Figure 15:
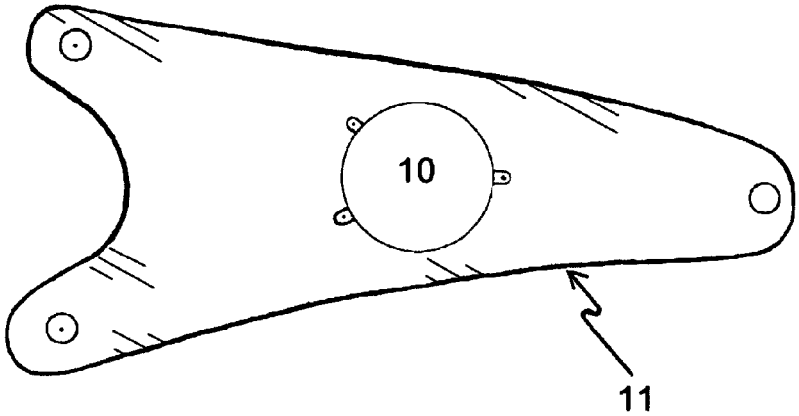
FIG. 15 is a bottom view of the integrated transducer/soundboard unit of the embodiments of FIGS. 1, 2, 6 and 8, having a solid plate magnet structure support (second plate).
Figure 17:
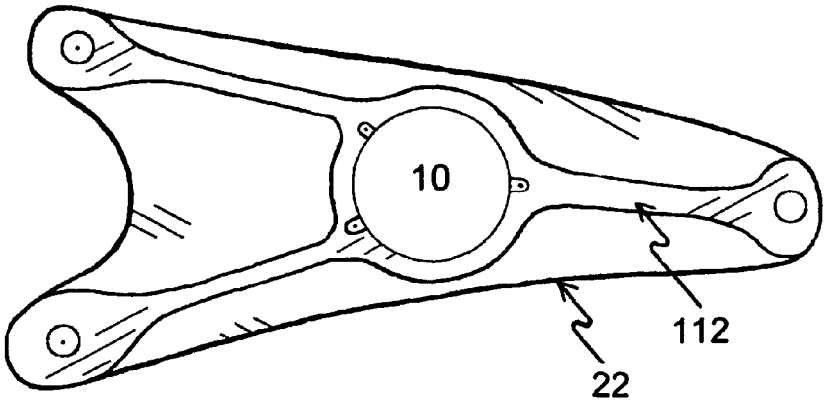
FIG. 17 is a bottom view of the integrated soundboard/transducer unit of an eighth embodiment of the invention, showing a hub and strut magnet structure support.

FIG. 15 is a bottom view of the integrated transducer/soundboard unit of the embodiments of FIGS. 1, 2, 6 and 8, having a solid plate magnet structure support, while FIG. 17 is a bottom view of the integrated soundboard/transducer unit of an eighth embodiment of the invention, showing a hub and strut magnet structure support 112. Hub and spoke support structure 112 allows an easy view of the bottom of front plate (sound board) 22, this embodiment altering acoustic properties due to the fact that the "bottom plate" is merely the hub and spoke structure 112 and thus the bottom or back plate (the magnet structure support) is minimized and the sound chamber 244 is nearly non-existent.

An embodiment has been tested having a three holed fixed soundboard and a solid magnet structure support.

The soundboards of various embodiments may be differing thicknesses, for example, the soundboard 22*c* of FIG. 12 is thinner than the soundboard 22*a* in FIG. 9, attenuating soundboard 22*c* towards a lower frequency response and a higher amplitude. The magnet structure support may also be located intermediate the front and back of the body of the guitar.

FIG. 2 shows a rigid body frame with a back skin 239, while FIG. 1 shows a body frame without: the back skin may be permanent or removable. Embodiments having the back skin 239 not in place tend to have reduced electronic feedback. In embodiments, the magnet may be on the soundboard and the voice coil on the second plate (rear plate).

A female threaded fitting 240 may be used with threaded adjustable coupling 241, allowing gentler adjustment forces and finer control of tone adjustment. Other forms of mechanical tone attenuation may be used, such as wedges, pads, paddles, flippers that secondarily variably couple the two plates.

As shown in FIG. 2, known electronic pickup devices may be employed in place of an integrated soundboard/transducer assembly (making use of the isolated soundboard assembly alone), or may be used in supplement to the integrated transducer: that is, a pickup according to the invention may be used along with a pickup of conventional type.

The disclosure is provided to allow practice of the invention by those skilled in the art without undue experimentation, including the best mode presently contemplated and the presently preferred embodiment. Nothing in this disclosure is to be taken to limit the scope of the invention, which is susceptible to numerous alterations, equivalents and substitutions without departing from the scope and spirit of the invention. The scope of the invention is to be understood from the appended claims.

What is claimed is:

1. A musical instrument comprising:

a substantially rigid body frame having an aperture therethrough;

a neck secured to the body frame at a first location;

a plurality of strings having first ends and second ends and attached to the neck at the first ends and attached to the body frame at a second location distal the first end, the strings under tension;

at least three suspension couplings located at least at third, fourth and fifth locations of the body frame proximate the aperture;

a soundboard assembly disposed at the aperture and attached to the suspension couplings the suspension couplings resonantly isolating the soundboard from the body frame, the soundboard assembly having a soundboard comprising a first plate;

a bridge secured to the soundboard, the plurality of strings urged against the bridge by the tension of the strings;

a transducer having a coil in resonant communication with the soundboard, the soundboard assembly further comprising a magnet structure support comprising a second plate, the soundboard assembly further comprising a separation between the first and second plates defining a chamber between the first and second plates, the second plate having a second aperture therethrough;

the transducer having a magnet structure attached to the second aperture of the second plate of the soundboard assembly, the transducer coil attached to the soundboard and suspended in magnetic communication with the magnet structure, whereby: relative motions of the soundboard and second plate cause relative motions of the voice coil and magnetic structure, inducing an electrical output signal.

2. The musical instrument of claim 1, further comprising:

a non-integral pick-up secured to the musical instrument.

3. The musical instrument of claim 1, wherein each of the at least three suspension couplings further comprise:

an adjuster having a first position in which the strings are disposed further from the neck and having a second position in which the strings are disposed closer to the neck;

whereby: the strings may be adjusted in a plurality of dimensions.

4. The musical instrument of claim 3, wherein a first of the three suspension couplings is disposed in-line with the axis of the strings, the first suspension coupling further comprising a hand hold allowing an immediate manual alteration of the first suspension coupling between the first and second positions, whereby: adjustment of the strings' position may be immediately manually done.

5. The musical instrument of claim 1, further comprising:

at least one sound hole or tuning port in the soundboard assembly.

6. The musical instrument of claim 1, wherein the soundboard and magnet structure support are attached together at two or more locations and the chamber defined therebetween is arcuate in shape.

7. The musical instrument of claim 1, wherein the soundboard and magnet structure support are connected by a plurality of spacers which maintain the plates in parallel separation.

8. The musical instrument of claim 1, further comprising:

a back skin across the back of the body frame, closing the aperture on the back side of the body frame.

9. The musical instrument of claim 1, further comprising:

a non-integral transducer secured to the musical instrument in addition to the integral transducer.

10. The musical instrument of claim 1, wherein:

the soundboard assembly further comprising a magnet structure support comprising a hub and a plurality of struts, the soundboard assembly further comprising a separation between the first plate and the magnet structure support defining an open chamber, the hub having a second aperture therethrough;

the transducer having a magnet structure attached to the second aperture of the hub of the soundboard assembly, the transducer coil attached to the soundboard and suspended in magnetic communication with the magnet structure, whereby: relative motions of the soundboard and hub cause relative motions of the voice coil and magnetic structure, inducing an electrical output signal.

* * * * *